United States Patent [19]

Rottmann

[11] Patent Number: 5,036,672

[45] Date of Patent: Aug. 6, 1991

[54] PROCESS AND APPARATUS FOR AIR FRACTIONATION BY RECTIFICATION

[75] Inventor: Dietrich Rottmann, München, Fed. Rep. of Germany

[73] Assignee: Linde Aktiengesellschaft, Wiesbaden, Fed. Rep. of Germany

[21] Appl. No.: 483,143

[22] Filed: Feb. 22, 1990

[30] Foreign Application Priority Data

Feb. 23, 1989 [DE] Fed. Rep. of Germany ..... 3905521
Jul. 26, 1989 [EP] European Pat. Off. ..... 89113815.8

[51] Int. Cl.[5] ..... F25J 3/02
[52] U.S. Cl. ..... 62/24; 62/39
[58] Field of Search ..... 62/23, 24, 38, 39

[56] References Cited

U.S. PATENT DOCUMENTS

| | | | |
|---|---|---|---|
| 3,375,673 | 4/1968 | Cimler et al. | 62/39 |
| 3,886,758 | 6/1975 | Perrotin et al. | 62/39 |
| 4,072,023 | 2/1978 | Springmann | 62/39 |
| 4,133,662 | 1/1979 | Wagner | 62/39 |
| 4,382,366 | 5/1983 | Gaumer | 62/39 |
| 4,718,927 | 1/1988 | Baurer | 62/39 |

*Primary Examiner*—Ronald C. Capossé
*Attorney, Agent, or Firm*—Millen, White & Zelano

[57] ABSTRACT

A process and an apparatus are disclosed for air fractionation by means of rectification. Nitrogen (16) withdrawn from the process is heated to an intermediate temperature, withdrawn, in part (30), out of the primary heat exchanger (17), and engine-expanded (31). The resultant expanded gas (32) transfers its cold in the primary heat exchanger (17) to air to be fractionated (1) and is then recompressed (33, 36).

27 Claims, 2 Drawing Sheets

PROCESS AND APPARATUS FOR AIR FRACTIONATION BY RECTIFICATION

BACKGROUND OF THE INVENTION

This invention relates to a low temperature air fractionation process and apparatus therefor.

There are many processes in the prior art based on a system wherein air is compressed, prepurified, cooled, and roughly fractionated into a nitrogen-rich fraction and an oxygen-rich liquid in a high pressure stage of a two-stage rectification unit. The two fractions are introduced at least in part to a low pressure stage of the rectification unit and further separated into oxygen and nitrogen. In U.S. Pat. No. 2,666,303, at least one gaseous nitrogen fraction is removed, heated, and engine-expanded at least in part. In this process, nitrogen from the low pressure stage is expanded to produce cold, i.e., refrigeration values. This is more economical than a cooling cycle operated with nitrogen from the high pressure stage, assuming that the low pressure stage is operated under a pressure, higher than atmospheric pressure which is the usual case. The conventional process exhibits the drawback, however, that the expanded portion of the gaseous nitrogen fraction from the low pressure stage can no longer be further utilized for purposes where the gaseous nitrogen must be under an elevated pressure.

SUMMARY OF THE INVENTION

An object of this invention is to provide an improved process without restricting the further usage of the gaseous nitrogen fraction.

Another object is to provide an apparatus for conducting the improved process.

Upon further study of the specification and appended claims, further objects and advantages of this invention will become apparent to those skilled in the art.

These objects are attained by heating at least a portion of the engine-expanded nitrogen and recompressing same, wherein at least a part of the work obtained during expansion is utilized for compression.

Engine expansion with recompression can be utilized in an especially advantageous way in air fractionation plants operated under elevated pressure, e.g., at least 3 bars in the low pressure stage, because in such cases, the pressure at the inlet of the expansion turbine (essentially equal to the pressure in the low pressure stage) is relatively high, and accordingly, a high degree of efficiency can be achieved. This holds true, in particular, for air fractionation facilities linked to power plants operated jointly with a coal gasification or heavy oil gasification installations. Examples of such gasification plants are described in U.S. Pat. No. 4,224,045 and the Final Report of Research Project 2669-1 of the EPRI "Advanced Air Separation for Coal Gasification - Combined Cycle Power Plants" (August 1987).

It also is advantageous to provide a portion, e.g., 30 to 70% of the power required for compression by energy introduced from outside of the process. Thereby, the expanded nitrogen proportion can again be brought to its original pressure (prior to expansion) or to a higher pressure, as the occasion requires. For example, the recompressed nitrogen, in case of a link between the air fractionation facility and a coal gasification power plant, after additional compression is introduced into the combustion chamber which is generally under an elevated pressure of at least about 15 bar. Such a combustion chamber is described in U.S. Pat. No. 3,731,495 or 2,520,862.

In this connection, it is especially advantageous if, according to further embodiments of the invention, for the nitrogen withdrawn from the low pressure column to be divided so that only a divided stream, e.g., 10 to 50% of the total nitrogen is engine expanded. The resultant expanded stream of gaseous nitrogen is then compressed to a pressure substantially equal to the pressure of the nitrogen when it was divided. The resultant compressed nitrogen is subsequently reintroduced into the unexpanded portion of the gaseous nitrogen fraction, preferably downstream of the point of division. By this type of operation, the entire gaseous nitrogen fraction is available at the pressure of the low pressure stage, e.g., 1.5 to 10 bar, and can be further utilized, for example, as indicated previously in the combustion chamber of a coal gasification power plant.

Especially in such applications of the process wherein the entire air fractionation and, in particular, the low pressure stage must be operated at relatively high pressures, e.g., a low pressure column pressure of about 2 to 8 bar, the resultant product purities are frequently unsatisfactory. This holds true for both products wherein the thus-produced nitrogen has a purity of about 92 molar %, if the resultant oxygen product has a purity of about 95 molar % and the air pressure is about 15 bars.

For this reason, it is advantageous in certain cases if, according to a further aspect of the invention, an additional nitrogen fraction is withdrawn from the head of the low pressure stage, is heated, compressed, then recooled, and introduced into the high pressure stage. In effect, this nitrogen fraction passes through an enrichment cycle. The nitrogen withdrawn from the low pressure stage and introduced into the high pressure stage via the enrichment cycle is condensed in indirect heat exchange with bottoms liquid from the low pressure stage, which is withdrawn in the liquid phase and fed as an additional reflux to the low pressure stage. Thereby—without affecting the mass transfer in the high pressure stage—the separation efficiency in the low pressure stage is increased resulting in product streams of higher nitrogen purities. Nearly every value of nitrogen purity is reachable, if a corresponding amount of nitrogen is fed through the enrichment cycle.

For conducting the process of the invention, there is provided apparatus comprising a primary heat exchanger containing passages for air and for nitrogen, a double rectifying column comprising a high pressure column and a low pressure column, an expansion turbine having an inlet and outlet; a compressor having an inlet and outlet; a conduit extending out of a central region of the primary heat exchanger and connected to a nitrogen passage and to the inlet of the expansion turbine; and a further conduit connecting the outlet of the expansion turbine to the inlet of the compressor and comprising a separate passage through the primary heat exchanger.

Preferably, the outlet of the compressor is connected to a nitrogen outlet conduit of the primary heat exchanger.

BRIEF DESCRIPTION OF THE DRAWINGS

The invention and additional details of the invention will be described in greater depth with reference to the attached drawings wherein.

DETAILED DESCRIPTION OF THE DRAWING

Figure 1:
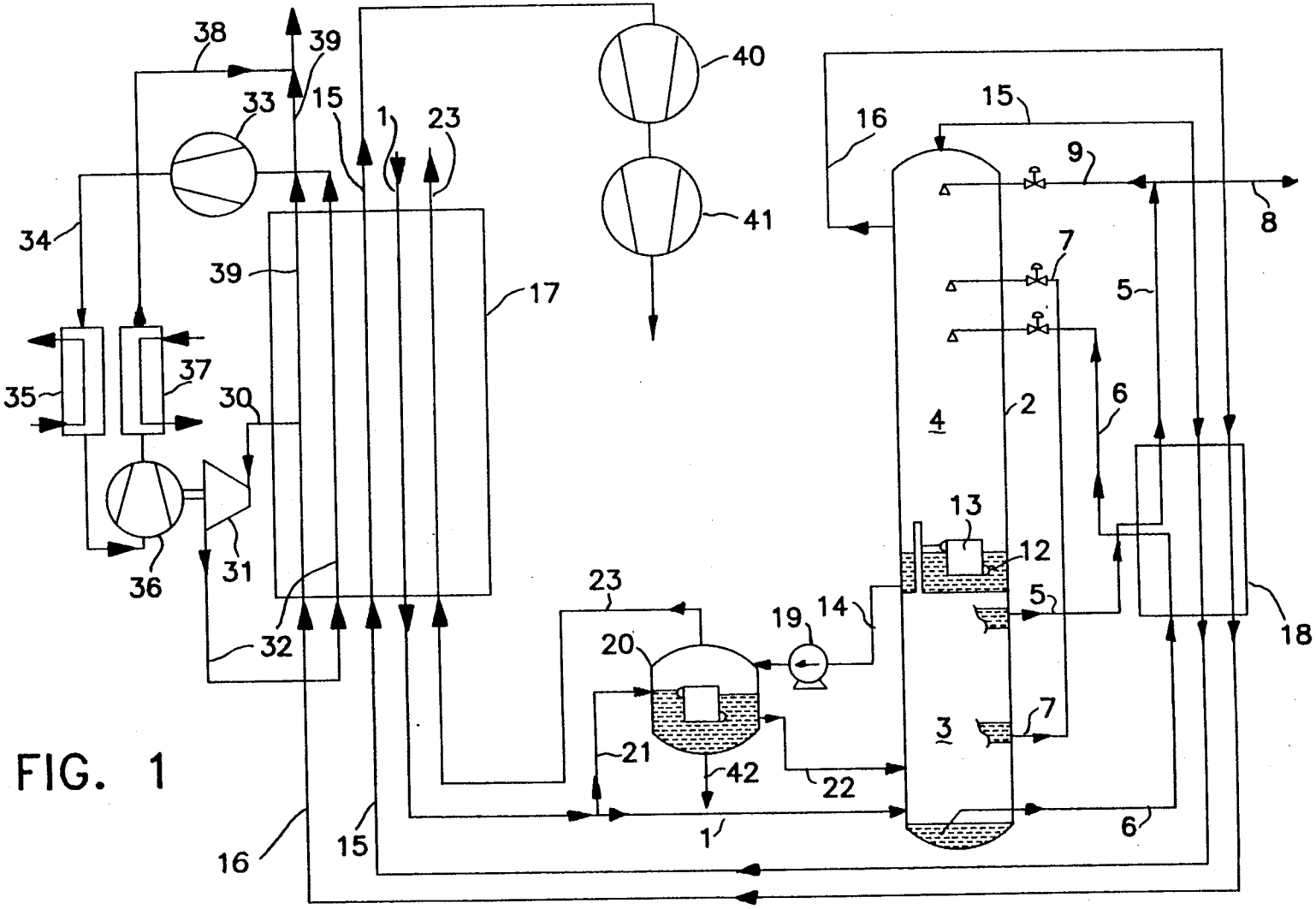
FIG. 1 schematically illustrates an embodiment of the invention.
Figure 2:
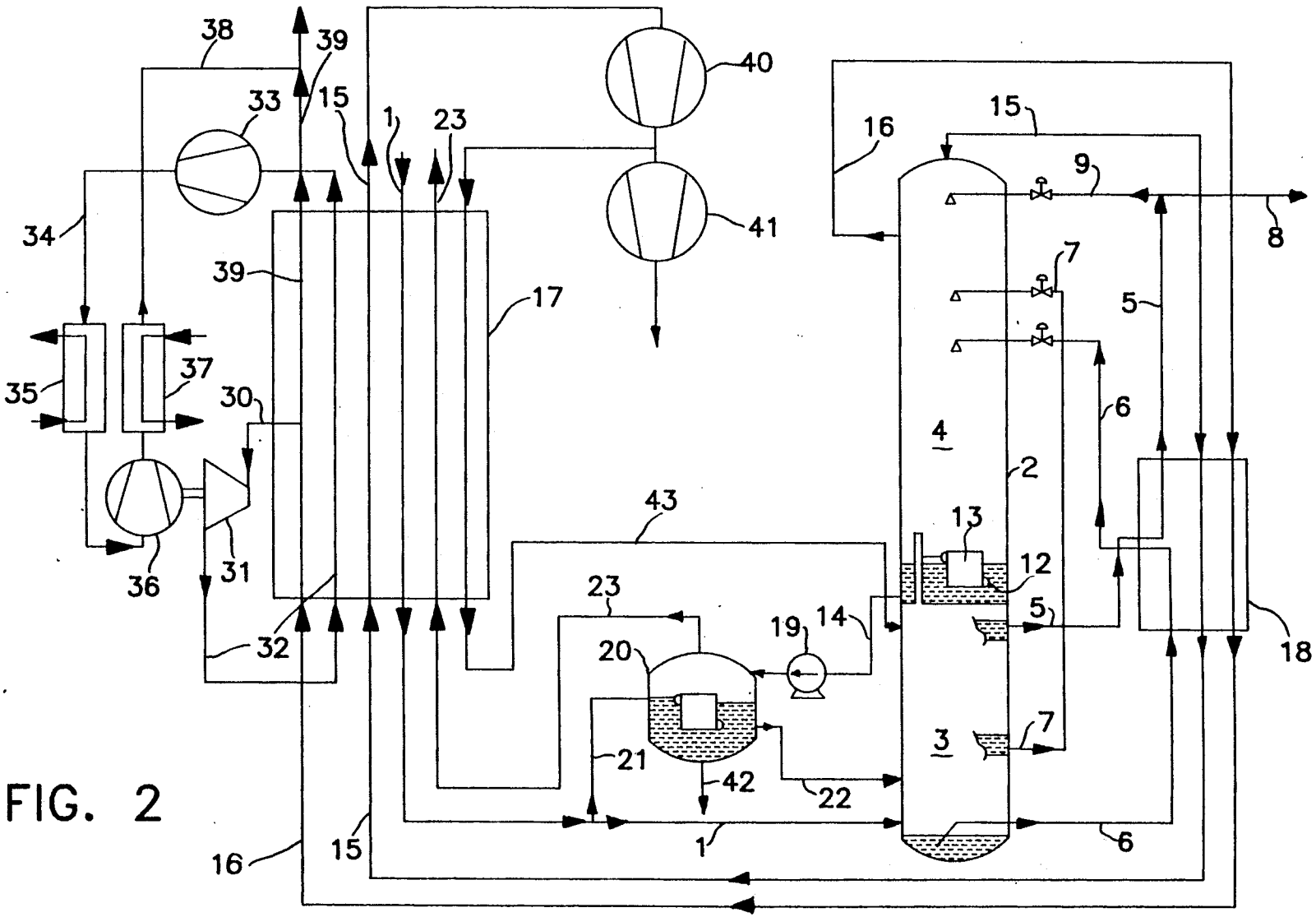
FIG. 2 illustrates another embodiment of the invention wherein a portion of gaseous product nitrogen is delivered to the high pressure stage of the rectification column.

Via conduit 1, compressed and prepurified air is introduced, cooled in a primary heat exchanger 17 in indirect heat exchange with product streams, and fed into the high pressure stage 3 of a two-stage rectifying column 2. The high pressure stage 3 (operating pressure: 6–20 bar, preferably 8–17 bar) is in indirect heat-exchange relationship with the low pressure stage 4 (operating pressure: 1.5–10 bar, preferably 2.0–8.0 bar) by way of a joint condenser/evaporator 13 provided with condensate return line 12. The thus-introduced air is preliminarily fractionated in the high pressure stage 3 into nitrogen and an oxygen-enriched fraction. The oxygen-enriched fraction is discharged via conduit 6 in the liquid phase, subcooled in heat exchanger 18 and fed with throttling into the low pressure stage 4. Nitrogen from the head of the high pressure stage 3 is withdrawn via conduit 5 likewise in the liquid phase, subcooled in heat exchanger 18, and one portion thereof is discharged as liquid product via conduit 8. The other portion of the nitrogen from high pressure stage 3 is introduced via conduit 9 as reflux into the low pressure stage 4. A less pure nitrogen fraction is removed via conduit 7 from an intermediate location in the high pressure stage 3 and is also fed, after throttling as liquid reflux to the low pressure stage 4.

Liquid oxygen (conduit 14), gaseous pure nitrogen (conduit 15), and impure nitrogen (conduit 16) are withdrawn as the products from the low pressure stage 4 and heated in primary heat exchanger 17, the nitrogen streams being additionally heated in heat exchanger 18 located between the primary heat exchanger 17 and the rectification column 2.

Prior to being fed into the high pressure stage 3, a portion, e.g., 25 to 40% (conduit 21) of the air in conduit 1 can be condensed in heat exchanger 20 in heat exchange with oxygen 14 from the bottom of the low pressure stage 4. The liquid 14 from the bottom of the low pressure stage 4 is brought, for this purpose, to a higher pressure by means of a pump 19 and is nearly completely vaporized in heat exchanger 20. The condensed air 22 is introduced into the high pressure stage 3 above the first feed point (conduit 1). The vaporized portion of the oxygen is removed via conduit 23 and heated in primary heat exchanger 17. Another portion (ca. 0.19%) of the oxygen is withdrawn as a liquid product stream via conduit 42 for avoiding explosion risks.

According to this invention, a portion, e.g., 20 to 50%, of the impure nitrogen in conduit 16 is withdrawn at an intermediate temperature of about 110–210K., preferably 135–185K., from the primary heat exchanger 17 via conduit 30 and engine-expanded in an expansion turbine 31 to a pressure of 2.6–1.4 bar, preferably about 2.0 bar. The intermediate temperature is to be compared to the cold end of the heat exchanger which is generally about 100 to 115K., and the warm end which is generally about 288 to 300K. The expanded nitrogen is recycled via conduit 32 to the cold end of the primary heat exchanger 17 and heated to approximately ambient temperature. During this step, the nitrogen transfers the refrigeration values obtained during expansion to the air to be fractionated in conduit 1.

In order to be able to remove the expanded portion of the nitrogen jointly with the unexpanded proportion (conduit 39), it is recompressed in two stages 33 and 36 connected by conduit 34 where in each case the heat of compression is subsequently removed (cooler 35, 37). From the second cooler (37), the nitrogen is passed via conduit 38 into conduit 39.

The second compression stage 36 is coupled with the expansion turbine 31 so that the work obtained during expansion is recovered for the process. In order to bring the gas back to its initial pressure (in conduit 30 or 39), it is necessary to provide supplemental compression stage 33 operated with externally applied energy. This additional externally applied energy, however, is converted into process refrigeration in an extraordinarily efficient way in accordance with this invention.

If the pure nitrogen is required under a pressure higher than that of the low pressure stage 4, then the nitrogen can be compressed after having been heated up. This takes place, in general, in several compressor stages 40, 41. In this process, the heat of compression is usually removed downstream of each stage 40, 41 by means of water coolers (not shown in the drawing).

In this case, in particular, it is advantageous to provide an enrichment cycle for increasing the conversion and the product purities. Via conduit 43, illustrated in dashed lines since it is optional, at least a portion, e.g., 10 to 35% of the pure nitrogen is branched off from conduit 15 so as to be adjusted to the pressure level of the high pressure column (in case of the embodiment, between compressor stages 40 and 41), recooled in primary heat exchanger 17, and then introduced via conduit 43 into the high pressure stage 3.

The additional nitrogen is condensed at the head of the high pressure stage and thereby vaporizes liquid in the bottom of the low pressure stage 4. This nitrogen is additionally withdrawn in the liquid phase via conduit 5 and introduced as reflux to the low pressure stage. A correspondingly increased amount of nitrogen is then also removed via conduit 15, heated up (18, 17) and compressed in the compressor stage 40 so that the enrichment cycle is closed. Furthermore, the exchange conditions of heat exchangers 17, 18 are balanced.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, if any, cited above and below, and of corresponding applications Fed. Rep. of Germany P 39 05 521.3, filed Feb. 23, 1989 and Europe Appln. 89113815.8, filed July 26, 1989, are hereby incorporated by reference.

EXAMPLE

The following example of a process for the separation of 100,000 $Nm^3/h$ air which operates under an air pressure of 14.2 bar (line 1) shall illustrate the effect of a nitrogen enrichment cycle. The pressure in the low pressure stage 4 is i.e. about 5 bar.

If the process works without enrichment cycle, i.e., no gas is fed through line 42, the impure nitrogen withdrawn via line 16 is contaminated by 7.5% oxygen. An enrichment cycle with 9,500 $Nm^3/h$ cycle gas (via line 42) leads to an oxygen content of 4.6% in the impure nitrogen stream. An amount equivalent to the cycle gas must additionally be fed as liquid from the high pressure stage 3 to the low pressure stage 4 via lines 5 and 9.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for air fractionation by rectification comprising cooling a compressed air stream; fractionating the cooled compressed air stream in a high pressure stage of a two-stage rectification to produce a nitrogen-rich fraction and an oxygen-rich liquid fraction; introducing at least a part of said nitrogen-rich fraction and said oxygen-rich liquid fraction into a low pressure stage of said two-stage rectification wherein they are separated into oxygen and nitrogen; at least one gaseous nitrogen fraction is removed from said low pressure stage and heated; and engine-expanding at least a part of said gaseous nitrogen fraction to produce work, wherein the improvement comprises:

heating and recompressing at least a portion of resultant expanded nitrogen from said engine-expanding and utilizing at least a portion of said work obtained during expansion for recompression.

2. A process according to claim 1, wherein a portion of the energy required for recompression is provided by an energy input from outside of the process.

3. A process according to claim 2, wherein said energy input from outside the process is 30–70% of the power required for recompression.

4. A process according to claim 1, wherein said portion of resultant expanded nitrogen fraction is recompressed to a pressure which is substantially equal to the pressure of said at least one gaseous nitrogen fraction prior to said engine-expanding of at least a part thereof.

5. A process according to claim 4, further comprising reintroducing the resultant recompressed nitrogen portion into an unexpanded portion of said gaseous nitrogen fraction.

6. A process according to claim 5, further comprising withdrawing a second nitrogen fraction from said low pressure stage and heating, compressing and recooling said second nitrogen fraction and then introducing at least a part of said second nitrogen fraction into said high pressure stage.

7. A process according to claim 4, further comprising withdrawing a second nitrogen fraction from said low pressure stage and heating, compressing and recooling said second nitrogen fraction and then introducing at least a part of said second nitrogen fraction into said high pressure stage.

8. A process according to claim 1, further comprising withdrawing a second nitrogen fraction from said low pressure stage and heating, compressing and recooling said second nitrogen fraction and then introducing at least a part of said second nitrogen fraction into said high pressure stage.

9. A process according to claim 8, wherein 10–35 vol. % of said second nitrogen fraction is introduced into said high pressure stage.

10. A process according to claim 1, wherein said low pressure stage is operated at a pressure of at least 3 bars.

11. A process according to claim 1, wherein the resultant recompressed nitrogen fraction is introduced into the combustion chamber of a coal gasification power plant.

12. A process according to claim 11, wherein said combustion chamber operates at a pressure of at least about 15 bar.

13. A process according to claim 1, wherein said part of said gaseous nitrogen fraction which is engine-expanded is 10–50% of said gaseous nitrogen fraction.

14. A process according to claim 1, wherein said low pressure stage operates at a pressure of 1.5–10 bar.

15. A process according to claim 1, wherein said low pressure stage is operated at a pressure of about 2–8 bar.

16. A process according to claim 1, wherein said high pressure stage is in indirect heat exchange relationship with said low pressure stage.

17. A process according to claim 1, wherein said high pressure stage is operated at a pressure of 6–20 bar.

18. A process according to claim 1, wherein said high pressure stage is operated at a pressure of 8–17 bar.

19. A process according to claim 1, wherein prior to being introduced into said high pressure stage, a portion of said cooled compressed air stream is condensed by heat exchange with a product oxygen stream removed from the bottom of said low pressure stage.

20. A process according to claim 19, wherein said portion of said compressed air feedstream which is condensed is 25–40 vol. % of said compressed air stream.

21. A process according to claim 19, wherein a liquid product oxygen stream and a gaseous product oxygen stream are removed from said heat exchange with a portion of said compressed air stream.

22. A process according to claim 21, wherein said liquid product oxygen stream is about 0.1% of the product oxygen.

23. A process according to claim 1, wherein said gaseous nitrogen fraction is heated to about 110–210K. before at least a part thereof is engine-expanded.

24. A process according to claim 1, wherein said part of said gaseous nitrogen fraction is engine-expanded to 1.5–2.6 bar.

25. A process according to claim 1, wherein an impure nitrogen fraction is removed from an intermediate location of said high pressure stage and introduced into said low pressure stage.

26. An apparatus for performing an air separation, comprising:

a heat exchanger containing a passageway for air to be cooled and a passageway for nitrogen to be heated;

a rectification column comprising a high pressure stage and a low pressure stage;

a first conduit means for delivering cooled air from said heat exchanger to said high pressure stage;

an expansion turbine having an inlet and an outlet;

a compressor means having an inlet and an outlet;

a second conduit means for removing a nitrogen fraction from an intermediate point of said heat exchanger and delivering said nitrogen fraction to said inlet of said expansion turbine; and a third conduit means connecting said outlet of said expansion turbine to said inlet of said compressor means and said third conduit means having a separate passageway through said heat exchanger.

27. An apparatus according to claim 26, wherein said outlet of said compressor means (33, 36) is connected to a nitrogen outlet conduit (39) from said heat exchanger (17).

* * * * *